US009816256B2

(12) United States Patent
Carpenter-Crawford et al.

(10) Patent No.: US 9,816,256 B2
(45) Date of Patent: Nov. 14, 2017

(54) OPENABLE DRAIN STRAINER

(71) Applicant: BrassCraft Manufacturing Company, Novi, MI (US)

(72) Inventors: Evan A. Carpenter-Crawford, Farmington, MI (US); Joseph Schutte, Ann Arbor, MI (US)

(73) Assignee: Brasscraft Manufacturing Company, Novi, MI (US)

( * ) Notice: Subject to any disclaimer, the term of this patent is extended or adjusted under 35 U.S.C. 154(b) by 224 days.

(21) Appl. No.: 14/642,983

(22) Filed: Mar. 10, 2015

(65) Prior Publication Data

US 2016/0040411 A1 Feb. 11, 2016

Related U.S. Application Data

(60) Provisional application No. 62/034,335, filed on Aug. 7, 2014.

(51) Int. Cl.

| | |
|---|---|
| ***E03C 1/26*** | (2006.01) |
| ***E03C 1/04*** | (2006.01) |
| ***E03C 1/18*** | (2006.01) |
| ***E03C 1/264*** | (2006.01) |
| ***B05B 1/06*** | (2006.01) |
| ***B05B 1/12*** | (2006.01) |
| ***B05B 1/16*** | (2006.01) |
| ***B05B 1/30*** | (2006.01) |
| ***B05B 12/00*** | (2006.01) |

(52) U.S. Cl.

CPC ..... *E03C 1/0405* (2013.01); *B05B 1/06* (2013.01); *B05B 1/12* (2013.01); *B05B 1/1618* (2013.01); *B05B 1/1663* (2013.01); *B05B 1/3046* (2013.01); *B05B 12/002* (2013.01); *E03C 1/18* (2013.01); *E03C 1/26* (2013.01); *E03C 1/264* (2013.01)

(58) Field of Classification Search

CPC ..... E03C 1/264
USPC ..... 4/286, 289, 290, 292, 287
See application file for complete search history.

(56) References Cited

U.S. PATENT DOCUMENTS

| | | | | |
|---|---|---|---|---|
| 948,900 | A * | 2/1910 | McKim | E03C 1/264 14/73 |
| 1,581,533 | A * | 4/1926 | Freer | E03C 1/242 138/89 |
| 2,829,380 | A * | 4/1958 | Wood | E03C 1/262 220/212 |
| 5,369,815 | A | 12/1994 | Martin | |
| 6,279,175 | B1 * | 8/2001 | Blaney | E03C 1/23 137/542 |
| 6,601,242 | B1 | 8/2003 | Rebischke | |

(Continued)

OTHER PUBLICATIONS

Silicone Sink Strainer & Stopper, Item #: 1345100V7, http_www.oxo.com_p-771-silicone-sink-strainer-stopper, OXO Website Advertisement.

(Continued)

*Primary Examiner* — Huyen Le
(74) *Attorney, Agent, or Firm* — Reising Ethington, P.C.

(57) ABSTRACT

The present disclosure includes an openable drain strainer with a central longitudinal axis. An openable basket includes a frame having a sidewall extending circumferentially around the axis, and a bottom movable with respect to the frame from a closed position to an open position to open the basket and facilitate removal of debris.

21 Claims, 5 Drawing Sheets

(56) References Cited

U.S. PATENT DOCUMENTS

| | | | | |
|---|---|---|---|---|
| 7,013,500 | B1 | 3/2006 | Lin | |
| 8,117,685 | B2 * | 2/2012 | Escobar | E03C 1/262 4/286 |

OTHER PUBLICATIONS

Splat Sink Strainer Black, Sku # 330852-040, http_www.umbra.com, Website Advertisement.

* cited by examiner

OPENABLE DRAIN STRAINER

CROSS-REFERENCE TO RELATED APPLICATION

This application claims the benefit of U.S. Provisional Application No. 62/034,335, filed Aug. 7, 2014. The content of the above application is incorporated herein by reference in its entirety.

TECHNICAL FIELD

This disclosure relates generally to strainers for drains.

BACKGROUND

A typical drain for a kitchen sink usually includes a strainer housing carried in a drain hole in a bottom of the sink, and a strainer basket removably carried in the strainer housing. The strainer basket is easily clogged with debris and can be unpleasant to clean; often requiring one hand to invert the strainer and a finger of the other hand to scrape the debris away.

BRIEF SUMMARY

An illustrative embodiment of an openable drain strainer with a central longitudinal axis includes an openable basket. The basket includes a frame having a sidewall extending circumferentially around the axis, and a bottom movable with respect to the frame from a closed position to an open position to open the basket and facilitate removal of debris.

DETAILED DESCRIPTION

Figure 1:
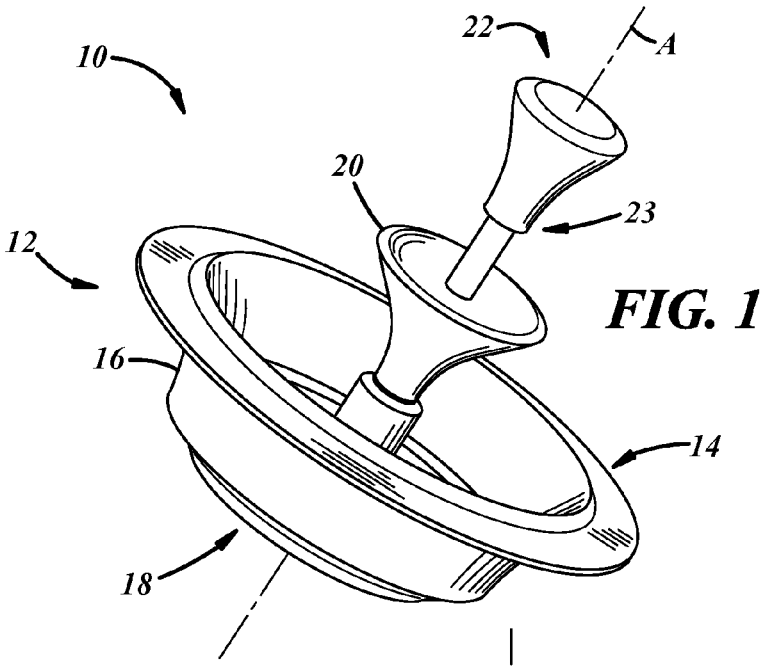
FIG. 1 is a perspective view of a strainer in accordance with an embodiment of the present disclosure.
Figure 3:
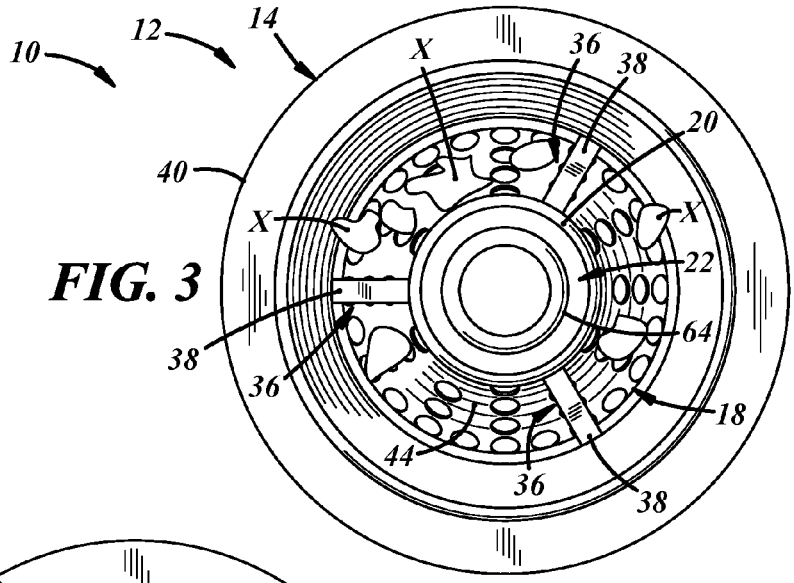
FIG. 3 is a top view of the strainer of FIG. 1, illustrating debris caught in the strainer.
Figure 4:
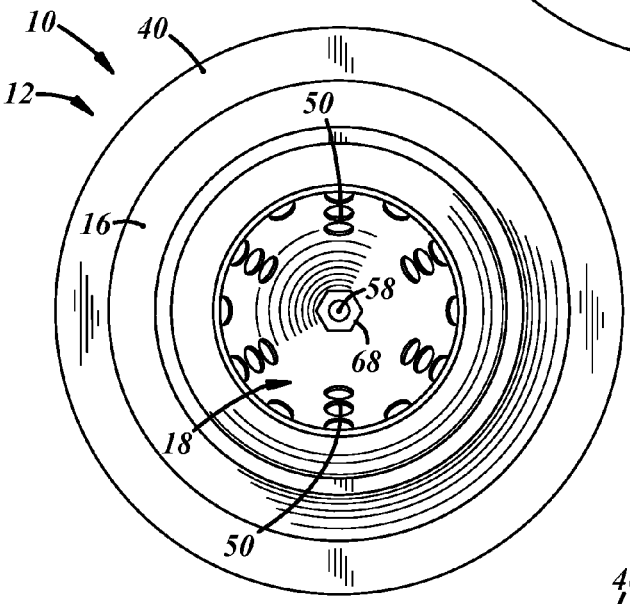
FIG. 4 is a bottom view of the strainer of FIG. 1.
Figure 5:
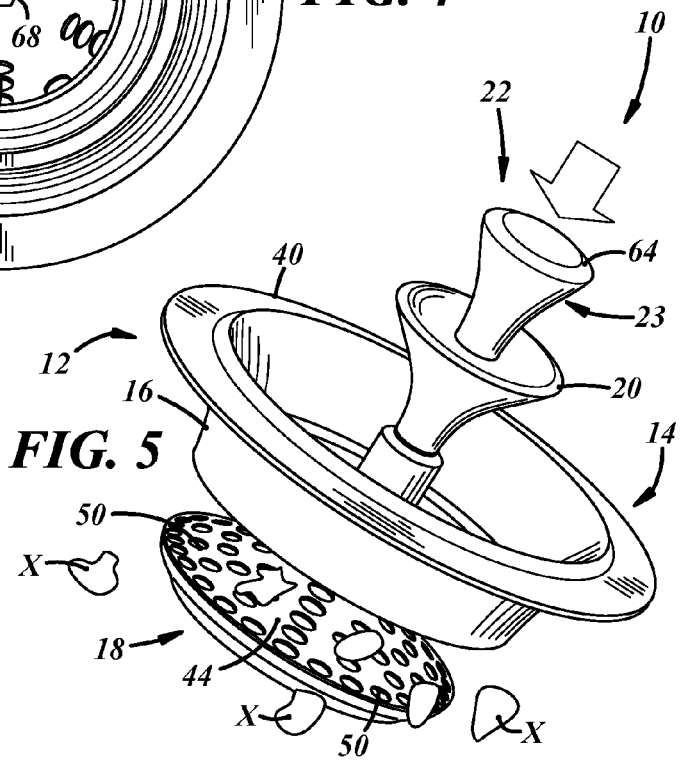
FIG. 5 is a perspective view of the strainer of FIG. 1, illustrated in an opened position to release the debris therefrom.

Referring specifically to the drawings, FIG. 1 shows an illustrative embodiment of an openable strainer 10, which may be used in a drain (not shown). As shown in FIG. 3, the strainer 10 can collect debris X. But, as shown in FIG. 5, the debris X may be easily removed from the strainer 10 by opening the strainer 10 as will be discussed in detail below. Accordingly, the strainer 10 may be less unpleasant to clean than conventional strainers, such that manual scraping of the debris X may be more easily avoided.

Figure 2:
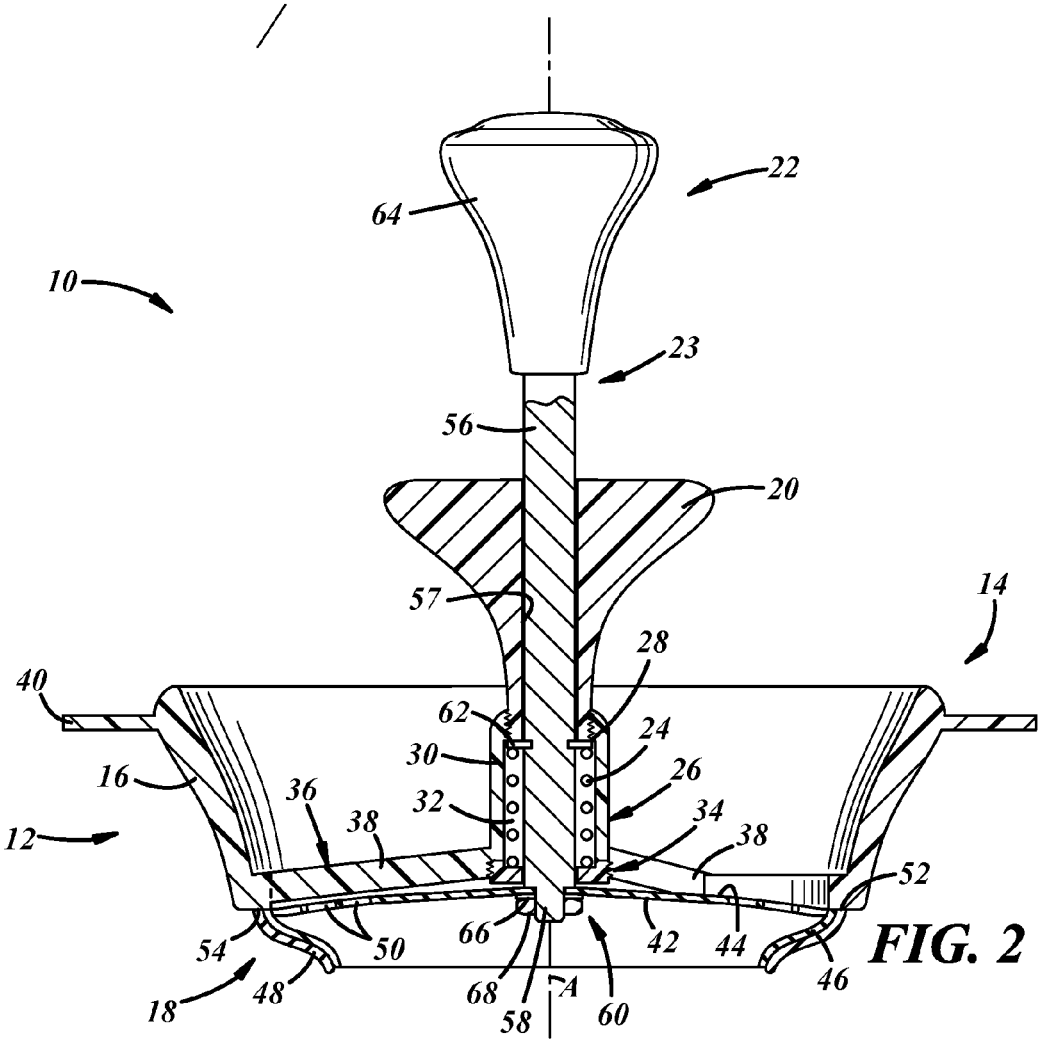
FIG. 2 is an enlarged, fragmentary, sectional view of the strainer of FIG. 1.

With reference to FIG. 2, the strainer 10 generally includes a central longitudinal axis A, an openable basket 12 to trap debris and including a frame 14 having a sidewall 16 extending circumferentially around the axis A, and a bottom 18 separate from the frame 14 and movable from a closed position to an open position with respect to the frame 14 to open the basket 12 and facilitate removal of debris. Also, the strainer 10 may include a finger grip or handle 20 carried by and coupled to the basket 12 to support a user's fingers, and an actuator 22 coupled to the bottom 18 and carried by the basket 12 to facilitate movement of the bottom 18 to an open position with respect to the basket 12. Further, the strainer 10 may include a spring 24 disposed between respective portions of the actuator 22 and the basket frame 14 to bias the bottom 18 toward the frame 14 to close the basket 12. The strainer 10 need not include the conventional separate drain plug movably coupled with respect to a strainer basket.

The basket frame 14 also may include a hub 26 located radially inward of the sidewall 16. The sidewall 16 may be circumferentially continuous and imperforate, as illustrated, or may be perforate. For example, the sidewall 16 could be of a pierced hole pattern design with a plurality of apertures (not shown) through the sidewall 16 in any desired pattern. More specifically, the apertures could be arranged in a grid pattern, or a radial pattern, and could be of any suitable shape and size. The hub 26 may be cylindrical or of any other suitable shape, and may include an upper wall 28, a sidewall 30, and a pocket 32 extending into a lower end of the hub 26 to the upper wall 28 to receive the spring 24. The basket 12 also may include a lower wall 34 that may be integral with, or separately coupled to, the hub 26 to trap the spring 24 in the pocket 32. The lower wall 34 may include or be part of a retainer, for instance, a threaded fastener that may be threaded to a threaded portion of the hub 26, a plug that may be snap fit or interference fit to a corresponding portion of the hub 26, or any other suitable retainer coupled in any other suitable manner to the frame 14.

The basket frame 14 further may include a web 36 extending between and connecting the hub 26 and the sidewall 16. The web 36 may extend radially outwardly from a lower end of the hub 26 to a lower end of the sidewall 16. The web 36 may include spokes 38, for example as shown in the illustrated embodiment, and the spokes 38 may be minimized in size, for example, in circumferentially extending width, to minimize debris getting caught thereon. Three radially extending spokes 38 are shown, but two, four, or any other suitable quantity and/or configuration may be used. The spokes 38 may extend at an upward angle, as shown to direct debris toward an inner surface of the sidewall 16. In other words, spoke upper surfaces at radially inner ends of the spokes 38 may be at a higher elevation than spoke upper surfaces at radially outer ends of the spokes 38.

The sidewall 16 may be circumferentially continuous and imperforate, as shown in the illustrated embodiment. But in other embodiments, the sidewall 16 may be perforate. As used herein, the term "perforate" includes structure having holes, spaces, pores, interstices, or any other water permeable structure. The basket sidewall 16 extends axially upwardly and, as shown, also may extend radially away, from the web 36. As illustrated, an outer surface of the sidewall 16 may be incurvately shaped. The sidewall 16 terminates in a free upper end, and the basket 12 also may include a mounting flange 40 extending transversely away from the sidewall 16 proximate the upper end thereof.

The bottom 18 of the basket 12 may include an upper wall 42 having an upper surface 44 that is excurvate to facilitate release of debris from the basket 12. Also, the basket bottom 18 also may include a bottom or side wall 46 that may include a seal 48, for instance an elastomeric overmolding, to seal against a sink drain rim (not shown). As illustrated, the bottom 18 may be perforate, for example, including a plurality of apertures 50 therethrough. Also, the bottom 18 may include a frame sealing portion 52 that may seal against a corresponding bottom sealing portion 54 of the frame 14 when the basket 12 is closed. The frame sealing portion 52 may be a radially outer peripheral margin of the seal 48.

The illustrated wall thicknesses of the various portions of the strainer basket 12 present just one example. The walls may be thinner or thicker than that shown, and the wall thicknesses may vary from one portion of the strainer 10 to another. Those of ordinary skill in the art will recognize that the wall thicknesses are application-specific and depend on performance requirements, material(s) used, and the like.

The handle 20 may include a lower end and an upper end having a radially outer periphery or diameter larger than that of the lower end. The handle 20 may be an integral portion of the basket 12 but, as shown in the illustrated embodiment, may include a component separate from the basket 12, for instance, one that is threaded, snap-fit, interference fit, fastened, adhered, welded, melted, or coupled in any other suitable manner to the basket 12. Also, the handle 20 may have an inverted conical shape that may have an incurvately shaped exterior surface, for instance, to facilitate a good grip between index and middle fingers of a user. In other embodiments, the handle 20 may be provided in a T-shape, may be constructed as a unitary single part or may be of multiple assembled pieces, and may be shaped, covered, overmolded, or otherwise configured to have grip enhancing features.

The actuator 22 may include a plunger 23 that may extend through a passage 57 in the handle 20 and the pocket 32 of the basket 12 and that may be coupled to the bottom 18 to displace the bottom 18 away from the frame 14 to open the basket 12. The actuator 22 may include a plunger shaft 56 that may extend through the basket 12 and may include an end 58 coupled to the openable basket bottom 18, a coupling 60 between the bottom 18 and the shaft end 58, a spring shoulder 62 to engage the spring 24, and an enlarged head 64 coupled to an upper end of the plunger shaft 56 to cooperate with a user's thumb. The shaft 56 may be hollow, or solid as shown, and may be composed of metal, plastic, or any other suitable material. In the illustrated embodiment, the coupling 60 may include a washer 66, and a nut 68 threadably coupled to the plunger shaft end 58 to fasten the basket bottom 18 to the plunger shaft 56. In other embodiments, the coupling 60 may include the end of the shaft 56 staked to the basket bottom 18, a screw threaded into a threaded end of the shaft 56, a circlip, a weld, or any other suitable coupling arrangement. As shown in the illustrated embodiment, the spring shoulder 62 may include a circlip, nut, or any other suitable retainer separately coupled to the shaft 56. In other embodiments, the spring shoulder 62 may be an integral portion of the shaft 56. The enlarged head 64 may be a separate component fastened, press fit, or otherwise coupled to the shaft 56, or may be an integral portion of the shaft 56. Additionally, the shaft 56 may be non-rotatably coupled to the bottom 18, for example, via cooperating splines, flats, or the like between the shaft 56 and the bottom 18, or via keys, stakings, or the like between the components, or by being tightly fastened thereto, or in any other suitable manner.

Although the actuator 22 of the illustrated embodiment is shown as a plunger style actuator, in other embodiments the actuator 22 may include a rotatable actuator, for instance, a screw type of actuator, or even may include a latch that can be opened to release the bottom 18 to allow it to fall away from the frame 14 and can be closed to capture the bottom 18 against the frame. Accordingly, in other embodiments, the strainer 10 need not include the actuator 22 at all. Instead, the bottom 18 may be moved away from the frame 14 under the force of gravity, by being pulled, or in any other suitable manner.

The spring 24 may include a compression coil spring to push on the actuator 22 as illustrated. But in other embodiments, the spring 24 may include an elastomeric puck, sleeve, or the like, or a tension spring configured to pull on the actuator 22 relative to the basket 12, or any other suitable spring arrangement. Accordingly, as used herein, the term "spring" includes not only the illustrated common coil spring, but any spring arrangement whether including a separate spring component, or one or more integral portions of one or more other components of the strainer 10 that are configured to be yieldably biased against one another to retract the bottom 18 to the closed position. The spring 24 may be concealed, for instance, with a passage, or may be exposed.

With reference to FIG. 1, in illustrative use of the strainer 10, a user may lift the strainer 10 out of a drain (not shown), and rotate the plunger shaft 56 relative to the basket 12 so that the bottom 18 rotates relative to the spokes 38 to loosen or scrape away debris (X, FIG. 3). Then, with reference to FIG. 5, the user may engage the actuator 22 to facilitate movement of the bottom 18 from a closed position to an open position with respect to the frame 14 to open the basket 12, for instance, over a garbage can or the like to dispose of the debris X. Thereafter, with reference to FIG. 2, the user may release the actuator 22 to allow the spring 24 to move the bottom 18 from the open position to the closed position with respect to the frame 14 to close the basket 12. Finally, the strainer 10 may be returned to the drain.

FIGS. 6-10 illustrate another illustrative embodiment of a strainer 110. This embodiment is similar in many respects to the embodiment of FIGS. 1-5 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

Figure 6:
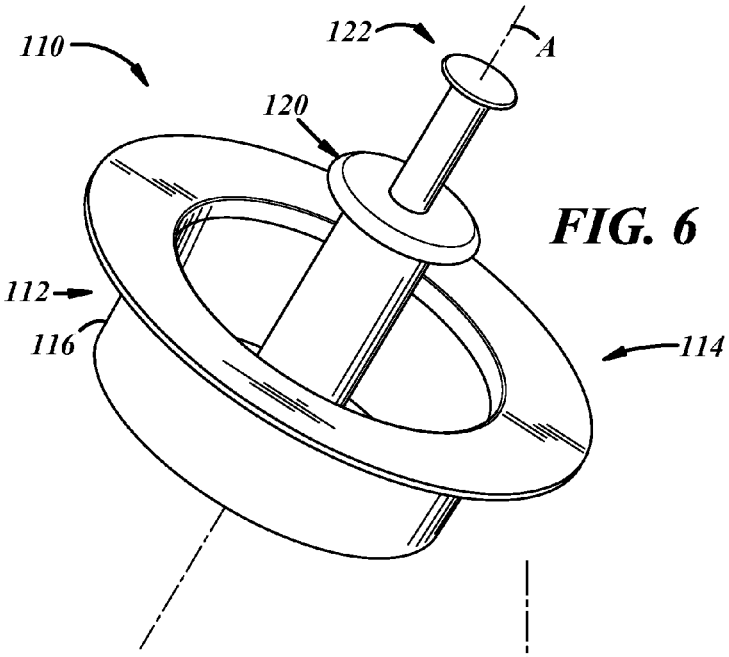
FIG. 6 is a perspective view of a strainer in accordance with another embodiment of the present disclosure.
Figure 7:
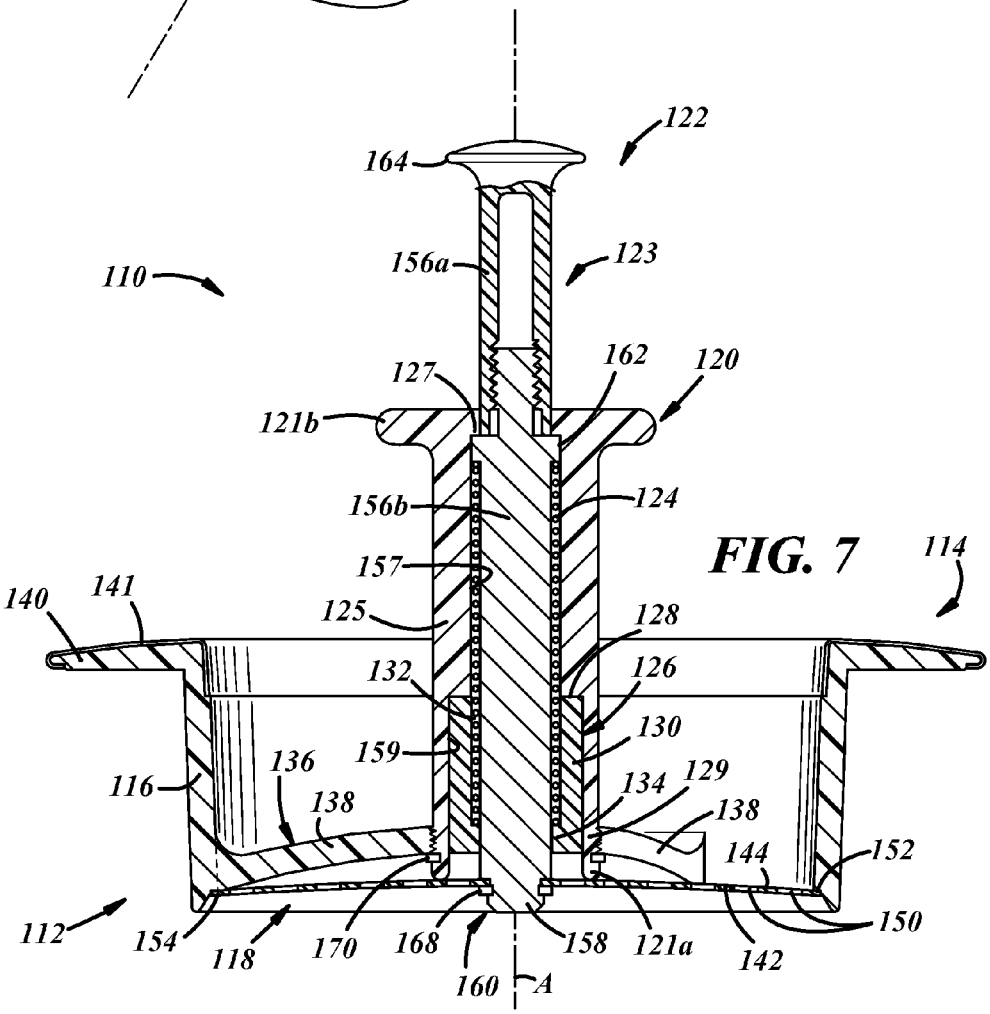
FIG. 7 is an enlarged, fragmentary, sectional view of the strainer of FIG. 6.

With reference to FIGS. 6 and 7, the strainer 110 generally includes a central longitudinal axis A, an openable basket 112 to trap debris and including a frame 114 having a sidewall 116 extending circumferentially around the axis A, and a bottom 118 separate from the frame 114 and movable from a closed position to an open position with respect to the frame 114 to open the basket 112 and facilitate removal of debris. Also, the strainer 110 may include a handle 120 carried by and coupled to the basket 112 to support a user's fingers, and an actuator 122 carried by the basket 112 and coupled to the bottom 118 to facilitate movement of the bottom 118 to an open position with respect to the basket 112. Further, the strainer 110 may include a spring 124 (FIG. 7) disposed between the actuator 122 and the bottom 118 to bias the bottom 118 toward the frame 114 to close the basket 112.

With reference to FIG. 7, the basket 112 also may include a hub 126 located radially inward of the sidewall 116 of the frame 114. The hub 126 may include an upper wall 128, a sidewall 130, a lower wall 134, and a pocket 132 extending into an upper end of the hub 126 to the lower wall 134 to receive the spring 124, wherein the spring 124 is trapped against the lower wall 134 within the pocket 132.

Also, the basket frame 114 further may include a web 136 extending between and connecting the hub 126 and the sidewall 116. The web 136 may extend radially outwardly from a lower end of the hub 126 to a lower end of the sidewall 116. The web 136 may include spokes 138 as shown in the illustrated embodiment.

As illustrated in FIG. 7, the sidewall 116 may be slightly conically shaped with a smaller lower end and a larger upper end. The sidewall 116 terminates in a mounting flange 140 extending transversely away from the sidewall 116 at the upper end thereof. A decorative overlay 141 may be carried over the flange 140.

Figure 8:
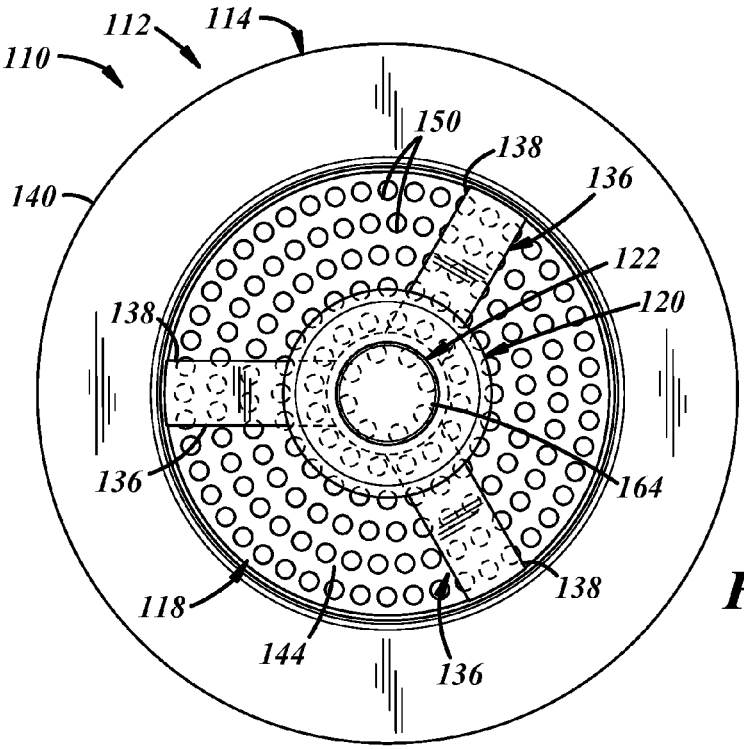
FIG. 8 is a top view of the strainer of FIG. 6.
Figure 9:
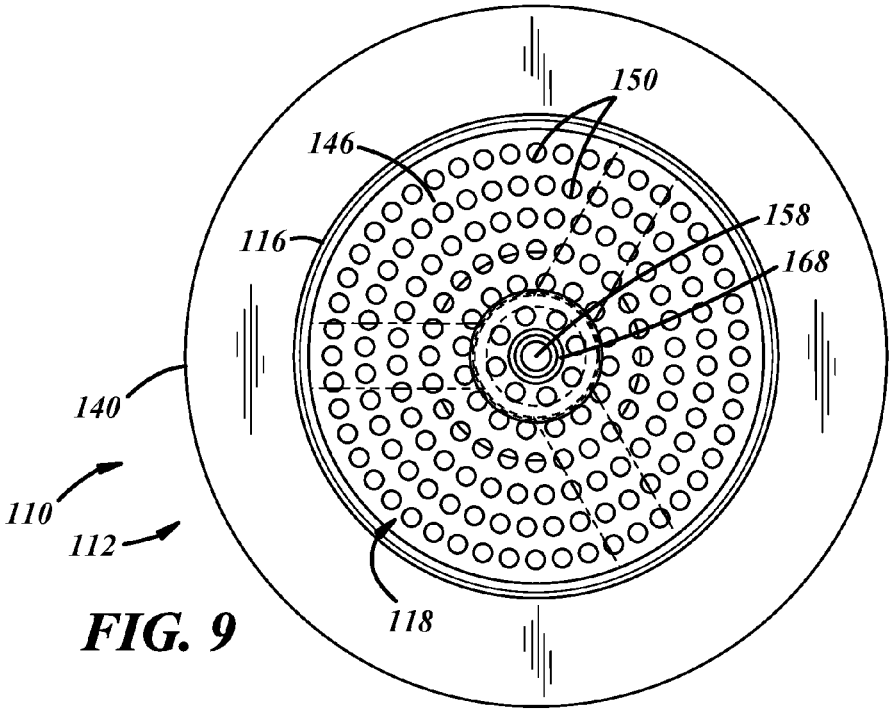
FIG. 9 is a bottom view of the strainer of FIG. 6.

With reference to FIGS. 7-9, the bottom 118 of the basket 112 may include a transversely extending wall 142 having an upper surface 144 (FIG. 8) and a bottom surface 146 (FIG. 9). As illustrated, the bottom 118 may be perforate, for example, including a plurality of apertures 150 therethrough. Also, with reference to FIG. 7, the bottom 118 may include a frame sealing portion 152 that may seal against a corresponding bottom sealing portion 154 of the frame 14 when the basket 112 is closed.

Also with reference to FIG. 7, the handle 120 may include a lower end 121*a*, an upper end 121*b* that may include a radially outer periphery or shoulder larger than that of the lower end 121*a*, and a body 125 extending axially between the ends 121*a,b*. The handle 120 may be a component separate from the basket 112. For example, the lower end 121*a* may include circumferentially spaced legs 129 that may be circumferentially interdigitated with the basket spokes 138 for retention against relative rotation therebetween. Also, the handle 120 may include a counterbore or enlarged pocket 159 defining a shoulder against which the upper end of the basket hub 126 locates, wherein the handle 120 may be coupled to the basket 112 via a fastener 170, for instance, a circlip or other suitable retainer, around the lower end 121*a* for retention against relative axial movement between the basket 112 and the handle 120.

The actuator 122 may include a plunger 123 that may extend through a passage 157 in the handle 120 and through the pocket 132 of the hub 126 of the basket 112, and is coupled to the bottom 118 to displace the bottom 118 away from the frame 114 to open the basket 112. The plunger 123 may include a first plunger shaft 156*a* that may extend into an upper or first end of the handle 120, and a second plunger shaft 156*b* that may extend through a lower or second end of the handle 120 and through the pocket 132 of the basket hub 126, and may locate against a radially inwardly extending shoulder 127 of the handle 120. The shafts 156*a*, 156*b* may be coupled to one another via corresponding threaded portions, for example, an externally threaded extension or boss on the second plunger shaft 156*b* and an internally threaded pocket in the first plunger shaft 156*a*. In any case, the plunger 123 may include an end 158 coupled to the openable basket bottom 118, a coupling 160 between the bottom 118 and the shaft end 158, a spring shoulder 162 to engage the spring 124, and a enlarged head 164 coupled to an upper end of the plunger 123 to cooperate with a user's thumb. In the illustrated embodiment, the coupling 160 may include a circlip fastener 168 clipped to the plunger end 158 to fasten the basket bottom 118 to the plunger 123.

Figure 10:
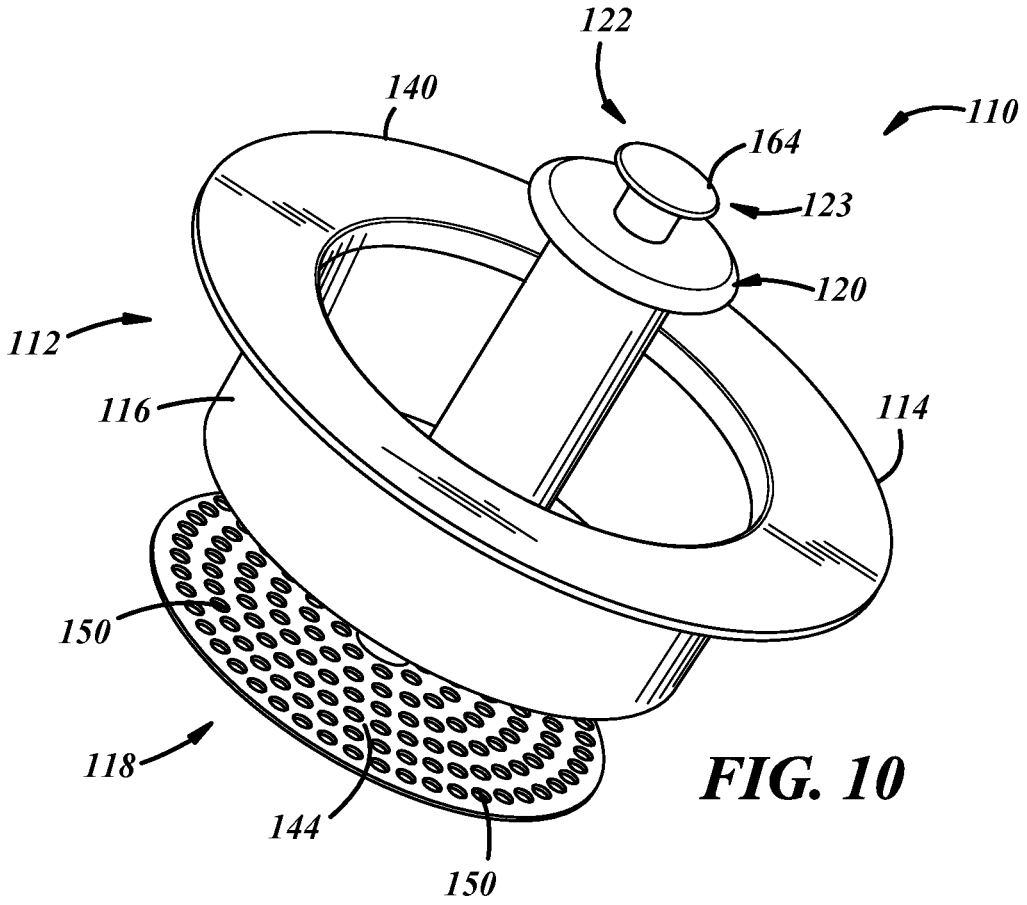
FIG. 10 is a perspective view of the strainer of FIG. 6, illustrated in an opened position.

With reference to FIG. 10, a user may engage the actuator 122 to facilitate movement of the bottom 118 from a closed position to an open position with respect to the frame 114 to open the basket 112. The basket 112 returns to its closed position under the force of the spring 124 when the user releases the actuator 122.

In general, the strainers 10, 110 may be manufactured according to techniques known to those skilled in the art, including molding, machining, stamping, casting, and/or the like. For example, various portions of the baskets 12, 112 may be molded as a single piece including, for instance, the sidewalls 16, 116, the flanges 40, 140, the webs 36, 136, and/or the hubs 26, 126. Likewise, any suitable materials can be used in making the strainers 10, 110 such as metals, composites, polymeric materials, and/or the like. The phrase "polymeric materials" generally includes relatively high-molecular-weight materials of either synthetic or natural origin and may include thermosets, thermoplastics, and/or elastomers. The term "elastomeric" generally includes a material, which at room temperature, can be stretched under low stress to about twice its original length or more and, upon release of the stress, will return with force to its approximate original length. Elastomeric also encompasses any of various elastic substances that may be rubber-like.

Some aspects of the configuration of the strainers 10, 110 are significant in that they enable a solution to a problem apparently not addressed in the prior art of drain strainers. The presently disclosed openable strainers 10, 110 provide openable baskets 12, 112 having movable bottoms 18, 118, which can be moved from a closed state holding trapped debris to an open state to facilitate release of debris therefrom. Accordingly, the presently disclosed strainers 10, 110 provide a simple but effective solution to an everyday, common household problem. It is believed that the presently disclosed strainers 10, 110 present a new type of drain strainer: an openable drain strainer.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. An openable drain strainer with a central longitudinal axis, and comprising:

an openable basket including:

a frame having a sidewall extending circumferentially around the axis; and a bottom separate from the frame and movable with respect to the frame from a closed position in which a portion of the bottom contacts a corresponding portion of the frame to an open position in which the portion of the bottom is spaced away from the corresponding portion of the frame to open the basket and facilitate removal of debris;

a plunger coupled to the bottom to displace the bottom away from the frame to open the basket.

2. The strainer of claim 1, wherein the bottom includes an elastomeric portion to seal against a sink drain rim.

3. The strainer of claim 1, wherein the bottom is perforate.

4. The strainer of claim 3, wherein the bottom includes a plurality of apertures therethrough.

5. The strainer of claim 1, wherein the bottom includes an upper surface that is excurvate to facilitate release of debris from the basket.

6. The strainer of claim 1, further comprising an actuator coupled to the bottom and carried by the basket to facilitate movement of the bottom to an open position with respect to the basket, and including the plunger carried through a portion of the basket to displace the bottom away from the basket, wherein the basket frame also includes a hub located radially inward of the sidewall, and a web extending between and connecting the hub and the sidewall.

7. The strainer of claim 6, further comprising a handle coupled to the basket to support a user's fingers and through which the plunger extends for depression by a user's thumb, wherein the handle includes an upper end with a flange, and a lower end coupled to the hub.

8. The strainer of claim 1, wherein the plunger comprises an enlarged head, a plunger shaft extending through the basket, and a coupling between the shaft and the bottom.

9. An openable drain strainer with a central longitudinal axis, and comprising:

an openable basket including:

a frame having a sidewall extending circumferentially around the axis, wherein the basket frame also includes a hub located radially inward of the sidewall, and a web extending between and connecting the hub and the sidewall; and a bottom movable with respect to the frame from a closed position to an open position to open the basket and facilitate removal of debris.

10. The strainer of claim 9, further comprising an actuator coupled to the bottom and carried by the basket to facilitate movement of the bottom to an open position with respect to the basket.

11. The strainer of claim 10, wherein the actuator includes a plunger carried through a portion of the basket to displace the bottom away from the basket.

12. The strainer of claim 11, further comprising a handle coupled to the basket to support a user's fingers and through which the plunger extends for depression by a user's thumb.

13. The strainer of claim 9, wherein the web includes spokes.

14. The strainer of claim 9, further comprising:

a plunger coupled to the bottom and carried by the hub of the basket to displace the bottom away from the frame to open the basket; and a spring disposed between respective portions of the plunger and the basket frame to bias the bottom toward the frame to close the basket.

15. An openable drain strainer with a central longitudinal axis, and comprising:

an openable basket including:

a frame having a sidewall extending circumferentially around the axis; and a bottom movable with respect to the frame from a closed position to an open position to open the basket and facilitate removal of debris;

an actuator coupled to the bottom and carried by the basket to facilitate movement of the bottom to an open position with respect to the basket, wherein the actuator includes a plunger carried through a portion of the basket to displace the bottom away from the basket; and a handle coupled to the basket to support a user's fingers and through which the plunger extends for depression by a user's thumb.

16. An openable drain strainer with a central longitudinal axis, and comprising:

an openable basket including:

a frame having a sidewall extending circumferentially around the axis, and also having a lower surface, a hub located radially inward of the sidewall, a web extending between and connecting the hub and the sidewall, a bottom separate from the frame, and movable away from the frame to open the basket and facilitate removal of debris;

a handle coupled to the basket to support a user's fingers; and a plunger extending through the handle and the basket hub, and coupled to the bottom to displace the bottom away from the frame to open the basket.

17. The strainer of claim 16, further comprising:

a spring disposed between respective portions of the plunger and the basket frame to bias the bottom toward the frame to close the basket.

18. The strainer of claim 16, wherein the bottom includes an elastomeric portion to seal against a sink drain rim.

19. The strainer of claim 16, wherein the bottom is perforate.

20. The strainer of claim 19, wherein the bottom includes a plurality of apertures therethrough.

21. The strainer of claim 16, wherein the bottom includes an upper surface that is excurvate to facilitate release of debris from the basket.

* * * * *